United States Patent [19]

Harrell

[11] 3,972,674

[45] Aug. 3, 1976

[54] CROP DRYING APPARATUS

[76] Inventor: Danny Hugh Harrell, 409 Dogwood Drive, Pelham, Ga. 31779

[22] Filed: July 9, 1974

[21] Appl. No.: 486,879

[52] U.S. Cl. ..... 432/500; 98/6; 98/55; 34/233; 296/137 B

[51] Int. Cl.[2] ..... A24B 1/02

[58] Field of Search ..... 432/500, 93, 162, 168, 432/169, 241; 98/6, 8, 10, 52–56; 34/212, 213, 218, 227, 231, 233, 170, DIG. 12; 62/239, 240; 296/51, 55, 56, 57 R, 68, 137 B

[56] References Cited

UNITED STATES PATENTS

| | | | |
|---|---|---|---|
| 1,344,057 | 6/1920 | Moore | 98/6 |
| 1,952,883 | 3/1934 | Nelson | 296/51 |
| 2,159,406 | 5/1939 | Schwebs | 98/6 |
| 2,293,316 | 8/1942 | Stebbins | 98/6 |
| 2,439,487 | 4/1948 | Reilly | 98/6 |
| 2,843,422 | 7/1958 | Black | 296/137 B |
| 2,983,500 | 5/1961 | Finley et al. | 432/36 |
| 3,244,445 | 4/1966 | Wilson | 294/5.5 |
| 3,250,405 | 5/1966 | Rosser | 294/5.5 |
| 3,367,643 | 2/1968 | Copeland, Jr. | 432/500 |
| 3,472,548 | 10/1969 | Comisac | 295/56 |
| 3,910,757 | 10/1975 | Taylor et al. | 432/500 |

*Primary Examiner*—John J. Camby
*Assistant Examiner*—Henry C. Yuen
*Attorney, Agent, or Firm*—Newton, Hopkins & Ormsby

[57] ABSTRACT

An apparatus and method of drying crops, the apparatus having a central heating system in which air is forced in a vertical path, downwardly, by a blower, across a heater and into a lower plenum chamber. A flapper valve in the plenum chamber regulates the ratio of heated air to be distributed to the flexible heated air ducts. A plurality of barns radially disposed, around the heater are respctively connected to the heated air ducts and are also connected to the upper plenum chamber of the heating system, via return air ducts. Fresh air is introduced through the upper plenum chamber. Each barn has a carriage consisting of wheels and axles and a tongue by means of which the barn is pulled by a tractor or other prime mover. The housing of each barn is mounted on the carriage and has a front door and a removable top. The crop to be collected and dried, if tobacco, is placed on racks and, if, peanuts or a grain, is through the open top, after the roof has been removed. The gable of the roof has a port with a flapper valve to regulate fresh air intake. The housing has a hoist for aiding in loading the racks of tobacco into the housing. The method includes collecting the crops in individual bins and simultaneously percolating heated air up through the crops in their individual bins. In some instances the method includes comingling the return air for reheating.

4 Claims, 4 Drawing Figures

CROP DRYING APPARATUS

BACKGROUND OF THE INVENTION

1. Field of the Invention

This invention relates to an apparatus and method of drying crops and is more particularly concerned with an apparatus for curing or drying tobacco, corn, peanuts, soy beans and other small grain by the circulation of heated air through the crops and the method carried out thereby.

2. Description of the Prior Art

In the past numerous tobacco barns have been developed which use an open flame for the curing of the tobacco leaves. Such stationary tobacco barns which employ open flames, provide a fire hazard since leaves may fall onto the flames and cause the tobacco leaves, themselves to catch fire and set the entire barn on fire. More recently the bulk curing of tobacco has come into wide practice. In the bulk curing of tobacco, the tobacco is clamped between cross bars of tobacco racks and then suspended in a barn so that the heated air is circulated up through the tobacco leaves from a heater. The barns are stationary members in which large quantities of tobacco are stored for curing.

Usually the barns, which are employed for curing the tobacco, are not used for any other purpose and are not suitable for use in the curing of other crops. Some attempts have been made to provide a portable barn for the curing of tobacco. U.S. Pat. No. 3,147,033 illustrates such a device.

Numerous patents such as U.S. Pat. No. 3,154,335 illustrate the suspending of tobacco leaves in racks. The patents to Hasler U.S. Pat. Nos. 3,105,713 and 3,110,326 as well as the patents to Wilson U.S. Pat. Nos. 3,134,583 and 3,244,445 illustrate the bulk curing of tobacco in tobacco barns wherein the tobacco is suspended by racks.

Heretofore, to the best of my knowledge, no portable bulk curing barn for tobacco has been devised and no such bulk curing device has been devised which utilizes a single heater for curing a plurality of barns filled with tobacco and other crops simultaneously, Furthermore, to the best of my knowledge, no portable barn has been devised which is capable of bulk curing tobacco as well as bulk drying peanuts, corn, soy beans and other small grains.

SUMMARY OF THE INVENTION

Briefly described, the present invention includes a plurality of curing barns, each of which is provided with a housing having a removable roof and an access door. Each housing is mounted on wheels so that it may be readily moved into the field when the barn is to be loaded. If tobacco is to be charged into the barn, the tobacco is loaded on conventional racks and then stored through the front door into the barn for bulk curing purposes. If peanuts, corn, soy beans or other grains are to be dried, it is preferable to remove the roof from the vehicle so that the harvested crop can be deposited therein. The barn housing has a perforated floor spaced above the bottom of the barn. The grain is deposited on this perforated bottom.

A central heating unit, capable of simultaneously supplying a plurality of barns with heat, includes upper and lower plenum chambers provided with a blower and heater therebetween. Air in the upper plenum chamber is driven downwardly by the blower, passing across a gas fired heater and thence into the lower plenum chamber. The barn housings are connected to both the upper and lower plenum chambers by ducts so that the heated air in the lower plenum chamber is directed simultaneously through all the lower ducts and into the space between the floor and the bottom of each barn. This heated air then percolates up through the openings in the floor and thence through the crop which is deposited in the bin formed by the housing. Thereafter, this heated air may pass out of the housing, in the event that the roof is removed from the barn or be returned to the upper plenum chamber via the upper duct. The air may also be discharged out of a discharge port in the roof portion of each barn. The fresh air is introduced through the upper plenum chamber.

DESCRIPTION OF PREFERRED EMBODIMENTS

Figure 1:
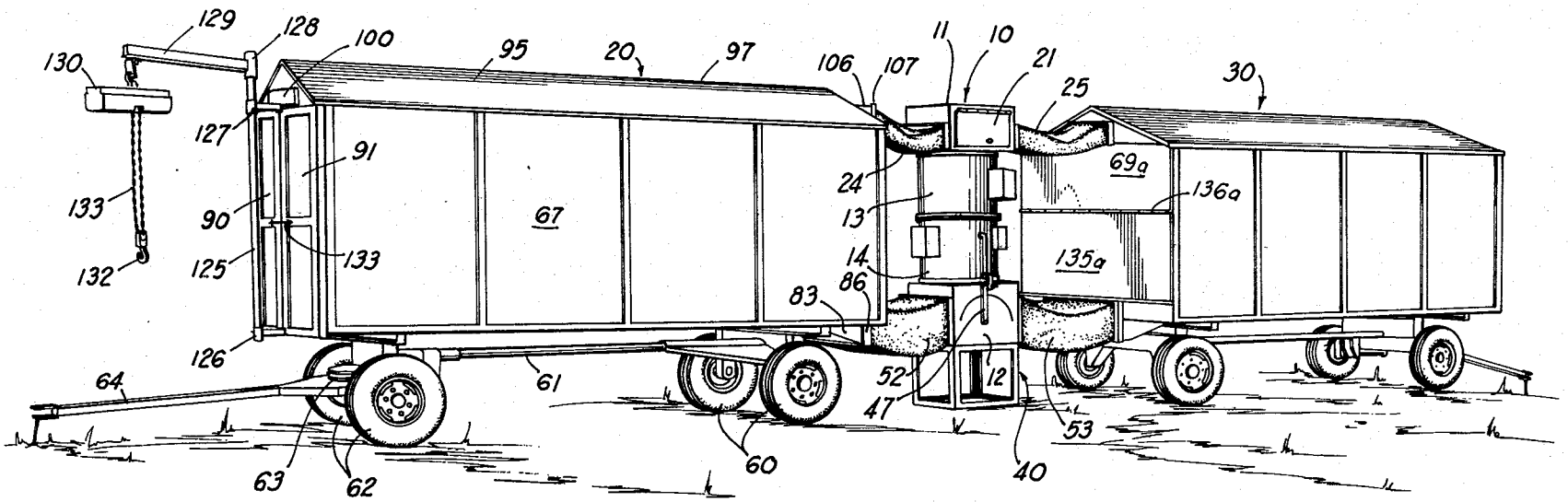
FIG. 1 is a perspective view of a crop drying apparatus constructed in accordance with the present invention.
Figure 2:
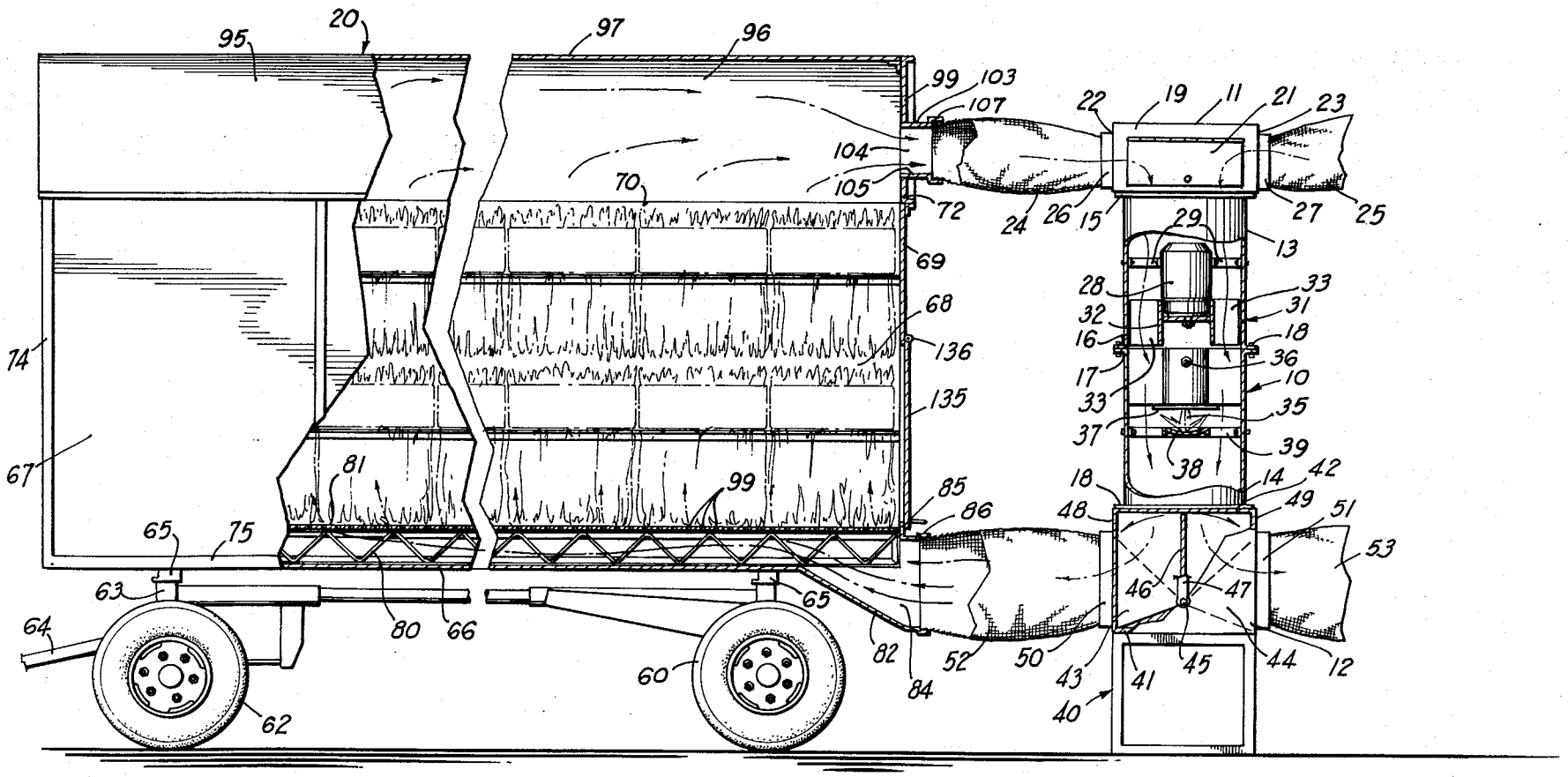
FIG. 2 is an enlarged side elevational view of the heater and one of the barns of the apparatus shown in FIG. 1, partially broken away and showing the flow of air therein.

Referring now in detail to the embodiments chosen for the purpose of illustrating the present invention, numeral 10 denotes the central heating system or heater for supplying heated air to the two curers, 20 and 30 depicted in FIG. 1. The central heater 10 includes, as best seen in FIG. 2, a rectangular upper plenum chamber 11 and a rectangular lower plenum chamber 12 separated by a pair of cylindrical, vertically disposed, tandem arranged, aligned ducts 13 and 14. The ducts 13 and 14 are approximately the same dimension configuration, the duct 13 having an upper peripheral flange 15 and a lower peripheral flange 16 while the lower duct 14 has an upper peripheral flange 17 and a lower peripheral flange 18. The flanges 16 and 17 abut each other and are joined together by removable bolts 18 so as to provide a central passageway for air. The upper plenum chamber 11 is a sheet metal box which is mounted centrally on the upper flange 15 and has an open lower side so that the plenum chamber 11 communicates with the passageway of duct 13. The upper plenum chamber 11 includes a pair of opposed sides, such as side 19. One of the opposed sides, such as side 19, is provided with an air intake port which can be opened or closed to ambient air by a hinged flapper plate 21. By the manipulation of the flapper plate 21, the amount of fresh air introduced into the upper plenum chamber 11 can be regulated.

Communicating with the opposite ends 22 and 23 of the upper plenum chamber 11 are a pair of air return ducts 24 and 25. These air return ducts 24 and 25 are reinforced by metal, wire or other rigid material so that they will not collapse under a vacuum of approximately 1 inch of mercury. The ducts 24 and 25 are connected by clamps 26 and 27 to the ends 22 and 23 of upper plenum 11 so that air passing through the ducts 24 and 25 will pass into the plenum 11 and thence downwardly into the duct 13, being mixed or comingled during such travel.

Disposed centrally within the duct 13 is an electric motor 28 which is supported by radially extending, circumferentially spaced, brackets, such as bracket 29. The motor 28 drives an impeller or fan 31 so as to force air in duct 13 downwardly into the duct 14. The motor 28 is concentrically disposed within the duct 13 and rotates a cylindrical hub 32 of the impeller 31. The blades 33 of the impeller 31 radiate from this cylindrical hub 32. The hub 32 is approximately the same diameter as a major diameter of the motor and, hence, substantially all of the air passes around the periphery of motor 28 and, thence, around the periphery of the butt 32 in being driven downwardly into the duct 14.

The duct 14 is provided with a plurality of radial, inwardly extending, fins 33 which support a concentric cylindrical combustion pot 34 in the central upper portion of the duct 14. The combustion pot 34 is immediately below the sleeve 32 so that air passing from the impeller 31 passes across the fins 33 and adjacent the sides of the combustion pot 34. The combustion pot 34 is closed at its top and open at its bottom. Gas is fed to a gas burner (not shown) within the combustion pot 34 so as to direct a gas flame 35, in a downwardly direction, out of the bottom of the combustion pot. A spark plug 36 is provided for automatically igniting the gas in the combustion pot 34.

Below the fins 33, the combustion pot 34 is provided with an annular perforated flange 37 over which the air passes for heat exchanging purposes. The downwardly directed flame 35 impinges upon a concaved cup 38 supported, in spaced relationship to the mouth of the combustion pot 34, by means of radially extending brackets 39. Thus, the air, passing downwardly in the duct 14, is heated and comingled with the products of combustion. A heater of the general type here described is illustrated in Bulletin No. 7185 by Hart-Carter which illustrates the crop and drying fan and supplemental heater combination. Of course, appropriate control for the gas, which can either be natural or liquefied petroleum gas, are provided.

The lower plenum chamber 12 is a sheet metal container, or box which rests upon a supporting frame 40. This support frame 40 rests upon level ground and is provided with a flat upper surface supporting the bottom surface of the lower plenum chamber 12. The plenum chamber 12, in turn, supports by its flat top 42 flange 18 of duct 14. An appropriate hole in top 42 permits the downwardly directed air from duct 14 to pass into the plenum chamber 12. The plenum chamber 12 also includes opposed sides 43 and 44 which support a transverse shaft 45. The shaft 45 carries an upstanding flapper valve 46 which is a flat plate which can be pivoted through the arc indicated in FIG. 2. A lever 47 on the shaft 45 provides for manual manipulation of the flapper valve 46.

The sides or ends 48 and 49 of the plenum chamber 12 are provided with opposed, heated air, discharge ports through which the downwardly directed heated air passes. Cowlings 50 and 51 secure the ends of opposed, flexible, heated air ducts 52 and 53 to sides 48 and 49, respectively, so as to communicate with the plenum chamber 12.

The duct 52 leads to one curer or barn 20 while the duct 53 leads to the other curer or barn 30. The construction of curers or barns 20 and 30 are substantially identical and hence the construction of curer 20 will be described in detail. The curer 20 includes a steerable running gear having a pair of rear wheels 60, a frame support structure 61, a cross bar assembly 63 to which are mounted the steerable wheels 64. A forwardly extending tongue or tow bar 64 is adapted to be attached to a tractor or other towing vehicle or prime mover so that the curer 20 will track behind such a vehicle. The upper cross bars 65 of the running gear support the bottom 66 of the housing.

The housing has four upstanding walls including a pair of opposed, parallel, upstanding sides 67 and 68 which project upwardly from the opposite edges of bottom 66. The other of the walls includes a back 69 across the upper portions of the back edges of sides 67 and 68. The sides 67 and 68 and back 69 are provided with aligned upper edges 70, 71 and 72 which are parallel to the bottom 66. The edges 70, 71 and 72 are thus disposed in a common horizontal plane. The abutting edges of the sides 67, 68, back 69 and bottom 66 are held together by angle irons, such as the reinforcing angle iron 75, seen in FIG. 2. The front of the closure includes a front frame having upstanding angle iron or strut 74 along the front edge of side 67 and a complementary upstanding parallel angle iron or strut 76 along the front edge of side 68. The lower ends of the angle irons 74 and 76 are joined by bottom cross strut 77 while the upper ends of the angle irons 74 and 76 are joined by an angle iron, upper cross strut 78. Extending along the upper surface of bottom 66 are a plurality of spaced longitudinally extending bar joists 80 which have open webs, as seen in FIG. 2, formed of rod material so that air can freely pass through each of the bar joists 80. A perforated or foraminous flat floor 81 is carried by the upper surfaces of the bar joists 80 so that the floor 81 is in spaced parallel relationship to bottom 66.

As seen in FIG. 2, the bottom 66 terminates inwardly of the end of the curer or barn 20 and is provided with a downwardly sloped air plate 82 which terminates rearwardly of the back 69. The outer edges of plate 82 are provided with side plates 83 and 84 while an angle iron or bar 85 extends between the upper edges of plates 83 and 84. Thus, a rectangular intake port for hot air is defined by the rear ends of plates 82, 83, 84 and bar 85, the port receiving the discharge end of the duct 52. A cowling 86 holds the duct 52 in place on the intake port. Thus, it is seen that the hot air is directed by the inclined plate 82 and sides 83 and 84 into a hot air chamber defined by the bottom 66, floor 81 and the lower portions of sides 67 and 68.

At the front of the curer or barn 20, a pair of opposed, hinged doors 90 and 91 are provided, the door 90 being hinged, by hinges 92, to angle iron 76 and the door 91 being hinged, by hinges 93, to angle iron 74. The doors 90 and 91 pivot inwardly toward each other so as to close the front of curer 20. Suitable weather stripping 94 on both doors 90 and 91 provide for sealing the curer 20 once the doors 90 and 91 have been closed. The weather stripping 94 also seals the forward end of the floor 81 and thus, when the doors 90 and 91 are closed, the air, forced into the hot air chamber between the bottom 66 and floor 81, must pass up through the perforations or openings 99 in floor 81. Of course, when the doors 90 and 91 are opened, the path of least resistance for the hot air is simply out through the open front of the hot air chamber. By such an arrangement, the curing of crops within the curer 20 can be stopped immediately by simply opening the doors 90 and 91.

The curer 20 is provided with a removable, peaked roof which includes a pair of flat upwardly inclined, roof plates 95 and 96 which are joined along their upper edge to form the peak 97 of the roof. The roof also includes a triangular front gable 98 and a triangular rear gable 99 which carry the plates 95 and 96. The front gable 98 has a lower straight edge which rests upon the cross strut 78 while the rear triangular gable 99 has a lower straight edge which rests upon the upper edge 72 of back 69.

The eaves of plates 95 and 96 overlie the sides 67 and 68 and so tend to center the roof in place. Suitable fastening means (not shown) can be employed in the event the roof is desired to be more permanently affixed to the open end of the housing.

Figure 3:
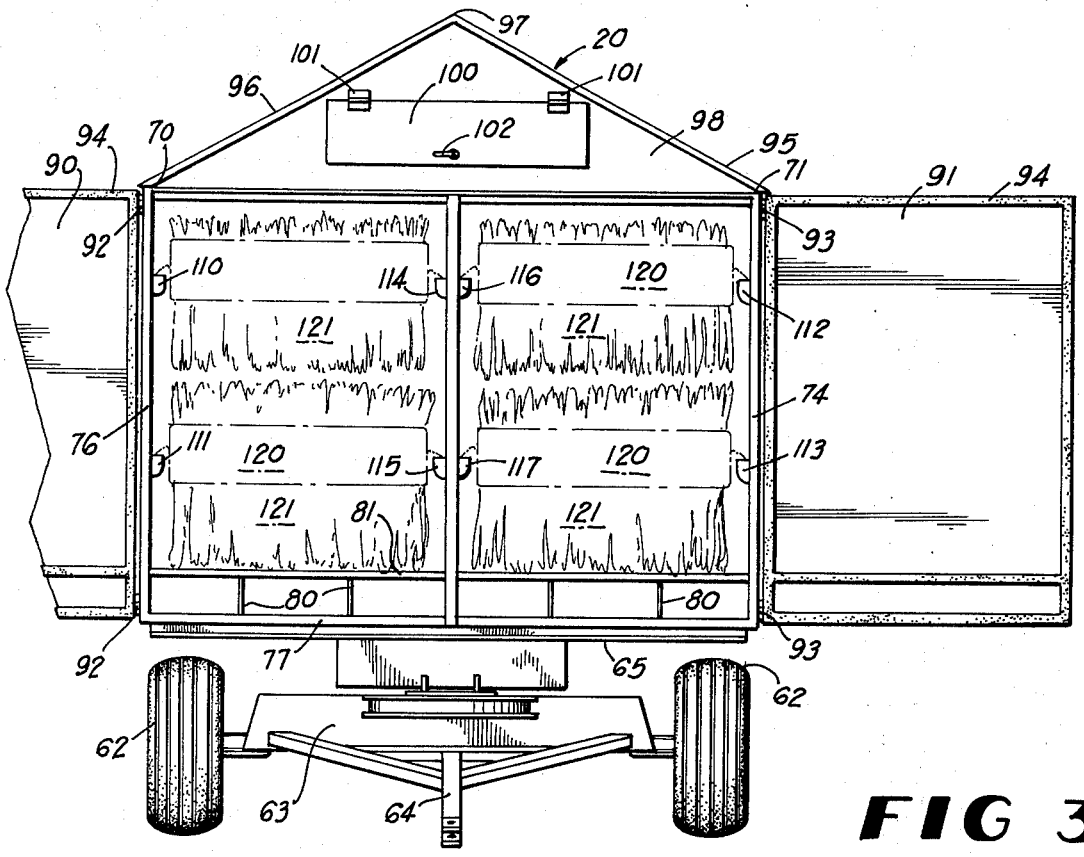
FIG. 3 is a front end view of the barn depicted in FIGS. 1 and 2, the doors of the barn being opened.

The front gable 98 is provided with a rectangular air discharge port over which is disposed a moveable flapper plate 100, hinged by hinges 101, as illustrated in FIG. 3. A handle 102 on the flapper plate 100 locks the flapper plate in a closed condition. The flapper plate 100 forms a valve which can be opened by varying amounts so as to permit discharge to the atmosphere of a portion of the air from the barn.

The gable 99 is provided with a rectangular discharge port defined by walls 103, 104, 105 and 106. The walls form a rectangular duct which receives and communicates with the end of duct 24, the duct being retained in place by cowling 107.

Within the housing there are vertically spaced, horizontally disposed, runners 110, 111, 112 and 113, seen in FIG. 3. The runners 110 and 111 are secured along the inner surface of wall 68 while the runners 112 and 113 are secured in opposed relationship along the inside surface of the wall 67. Central removable runners 114, 115, 116 and 117 are disposed in longitudinal, parallel, horizontal relationship at the central portion of the housing, the runners being supported by uprights such as upright 118 to divide the housing into a pair of compartments. The upright 118 extends upwardly at the front of the barn from the mid-portion of cross strut 77 to the mid-portion of cross strut 78. Thus it is seen that runner 114 is disposed in opposed relationship to runner 110, runner 115 is disposed in opposed relationship to runner 111, runner 116 is disposed in opposed relationship to runner 112 and runner 117 is disposed in opposed relationship to runner 113 so as to support between each pair of runners, a plurality of racks such as the rack depicted in U.S. Pat. No. 3,244,445. In FIGS. 1 and 2, the racks are denoted by the numeral 120 and each is illustrated as being provided with a plurality of tobacco leaves, denoted by the numeral 121.

Referring to FIG. 1, it will be seen that a removable hoist is provided for loading the curer 20. This removable hoist assembly includes a stanchion 125 supported by a pair of outwardly projecting brackets 126 and 127. The brackets 126 and 127 are mounted on the struts 77 and 78 respectively and are movable from one curer 20 to another curer 30, for example. The upper end of the stanchion 125 carries a pivotal cap 128 provided with a cantilever boom arm 129 which supports the hoist 130 and its chain 131 provided with a hook 132.

The doors 90 and 91 are maintained in a closed condition by cross bolt 133 or some other suitable conventional fastening means.

The back 69 is provided with an access gate 135 suspended from a piano hinge 136 on the lower edge portion of the back 69. A similar piano hinge **136*a* is seen in FIG. 1 on curer 30. This piano hinge 136*a* supports an access gate 135*a* from a back 69*a*.**

As seen in FIG. 1, the curer 30 is connected to the heater 10 by means of hot air discharge duct 53 and return duct 25, the duct 53 being connected at the bottom rear portion of the curer 30 in the same manner that the duct 52 is connected to the curer 20. In like fashion the duct 25 is connected to curer 30 in the same fashion as duct 24 is connected to curer 20. Since there is a slight vacuum on the ducts 24 and 25 by the plenium chamber 11, these ducts should be relatively rigid.

When tobacco is harvested, the barns or curer 20, 30, etc., are towed into the fields adjacent where the racks 121 are to be loaded with tobacco. When loaded the racks 121 are, then, fed through the front access opening onto the opposed pairs of runners 110, 114 and runners 111, 115 and runners 112, 116 and runners 113, 117 until the barn or curer 20 or 30 is filled, as depicted in FIGS. 1 and 2. Then the doors 90 and 91 are closed and the filled barns or curers 20 and 30 are towed to a position adjacent the heater 10 as depicted in FIG. 1. The ducts 24 and 52 are then installed, as depicted in FIGS. 1 and 2. The heater 10 is started so as to provide hot air heated by flame 35 for curing the tobacco. The heated air driven by impeller 31 passes from duct 14 via lower plenum chamber 12 and duct 52 into the hot air chamber defined by bottom 66 and floor 81. Since the doors 90 and 91 are closed, the heated air will pass upwardly through the perforations 99 in the floor 81 and thence upwardly through the tobacco 121, being returned through the port defined by walls 103, 104, 105 and 106 and the duct 24 to the upper plenum chamber 11. If fresh air is desired, as in the initial curing of the tobacco, where as appreciable amount of the moisture must be discharged the atmosphere, the flapper plate 21 is opened on the plenum chamber 11 and the flapper plate 100 is also opened on the gable 98, thereby permitting the moisture laden air which has passed through the tobacco 121 to pass out of the port in gable 98 and returning only a minimal amount of this air for reheating and recirculation. Of course, after the moisture has been driven out of the tobacco, it may be found desirable to close or partially close the flapper plates 21 and 100.

By manipulation of the lever 47, the amount of hot air fed to the respective curers 20 and 30 can be regulated so that essentially the same temperature is maintained in each of the curers 20 or 30. The instruments for determining the temperature within the interior of the housings of the curers 20 and 30 are not illustrated since this is well known in the art and the curing procedure is also well known in the art. Suffice it to state that the flame 35 may be regulated through automatic equipment in one of the barns and the lever 47 can be manipulated so as to assure reasonably even curing of both barns simultaneously.

Since the return air from the housings of curers 20 and 30 is comingled before being recirculated and since the temperature and volume of heated air delivered to the housings of the two curers 20 and 30 is approximately the same, the curing of the tobacco should take place at about the same rate.

When it is desired to dry peanuts, corn, soy beans or the like, the roof and central runners 114, 115, 116 and 117 of each of the curers 20 or 30 are removed therefrom including the plates 95 and 96 and the front and back gables 98 and 99 which simply rest upon the upper edge portion of the remainder of the housing. With the roof and central runners removed, the open upper end of the housing permits the grain or peanuts to be deposited through this open top into the interior of the housing. When the housings without their roofs are hooked up to the heater, only the ducts 52 and 53 are used and the ducts 24 and 25 are preferably removed from the upper plenum chamber 11. This enables the fresh air to enter through the upper plenum chamber 11, regardless of whether or not the flapper plate 21 is closed. This air is then passed downwardly through ducts 13 and 14 into the lower plenum chamber 12, being heated in the same way as previously described. Thence, the air is distributed through the ducts 52 and 53 to the hot air chambers of each of the curers 20 and 30. With the doors closed, the hot air percolates up through the perforated floor 81 of curer 20 and passes into the atmosphere after heating and drying the peanuts, corn, soy beans, or the like which is disposed within the closure.

The holes, openings or perforations 99 in floor 81 are sufficiently small that the grain deposited in the housing does not pass therethrough.

It is readily seen that the curer 20 or 30 can be towed to the vicinity where the harvesting of the crops is taking place. Indeed, in the harvesting of corn, soy beans and other small grain, the curer 20, with its roof removed, can be towed alongside the combine (not shown) so as to receive the discharge therefrom.

Figure 4:
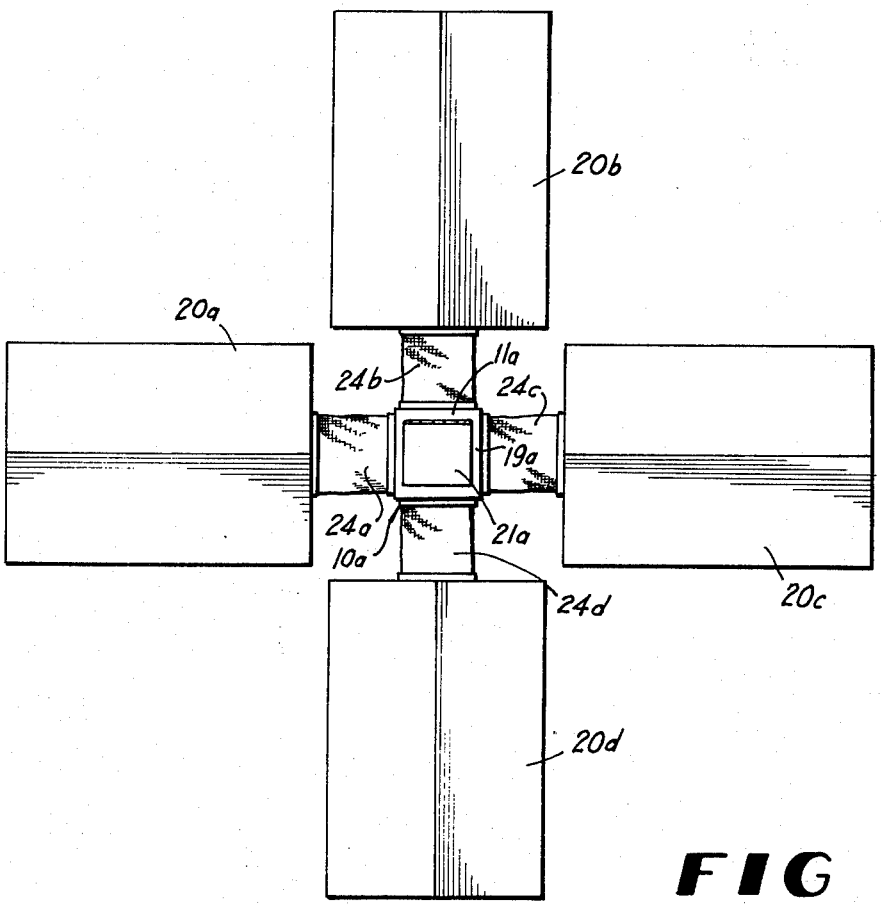
FIG. 4 is a schematic plan view of a second embodiment of the present invention.

In the second embodiment, as illustrated in FIG. 4, it will be seen that, if desired, four curers 20*a*, 20*b*, 20*c* and 20*d* may be arranged, at 90° from each other, circumferentially around the heater 10 so that the ducts, such as duct 24*a*, 24*b*, 24*c* and 24*d* are connected to the four sides of the plenum chamber 11*a*. Otherwise the curers are connected to the heater in the fashion described for the previous embodiment, there being four ducts, such as duct 52, connecting the lower plenum chamber (not shown) to the lower portion of the curers 20*a*, 20*b*, 20*c* and 20*d*. In the arrangement depicted in FIG. 4, a flapper plate 11 is provided in the upper panel 19*a* of the upper plenum chamber 11*a* so as to permit fresh air to be drawn into the upper plenum chamber 11*a*.

I claim:

1. A barn for the storage, transportation and drying of crops comprising:

a. a running gear having a carriage, wheels for supporting said carriage, and means for propelling said carriage over the ground on said wheels; and b. a housing supported on said carriage, said housing having a plurality of walls forming a bottom, a pair of upright opposed sides, an upright front, and an upright back, a roof for the sides and front and back walls; and c. a foraminous floor above said bottom for defining, with said bottom, a heated air chamber;

d. said housing having an air intake port in the lower portion of one of said walls; and e. means for removably connecting said air intake port to an external heater for introducing air under pressure from said heater into said chamber through said port;

one of said walls including an access door extending on opposite sides of the plane of said floor for simultaneously permitting access to the interior of said housing and opening a portion of said chamber to the atmosphere, when said door is opened.

2. The barn defined in claim 1 wherein said roof is removable for permitting access to the interior of said housing.

3. The barn defined in claim 1 including vertically spaced parallel central runners removable disposed longitudinally in the central portion of said housing, additional runners affixed, to the inside surfaces of the side wall in opposed relationship to said central runners for receiving and supporting by their ends racks containing tobacco.

4. The barn defined in claim 3 wherein said one wall includes a vertical post means for supporting said central runners and engaging said access door.

* * * * *